United States Patent [19]

Crawford

[11] 4,426,125

[45] Jan. 17, 1984

[54] FLAT CABLE ELECTRICAL CONNECTOR

[75] Inventor: Christopher L. Crawford, Harrisburg, Pa.

[73] Assignee: AMP Incorporated, Harrisburgh, Pa.

[21] Appl. No.: 294,675

[22] Filed: Aug. 20, 1981

Related U.S. Application Data

[63] Continuation-in-part of Ser. No. 204,099, Nov. 5, 1980, Pat. No. 4,341,430.

[51] Int. Cl.[3] ..... H01R 23/66

[52] U.S. Cl. ..... 339/99 R; 339/176 MF

[58] Field of Search ..... 339/75 MP, 97 R, 97 P, 339/99 R, 176 MP, 176 MF, 98, 17 F; 220/338

[56] References Cited

U.S. PATENT DOCUMENTS

| | | | |
|---|---|---|---|
| 2,732,581 | 1/1956 | Heck | 220/338 |
| 3,023,923 | 3/1962 | Geib et al. | 220/338 |
| 3,342,190 | 9/1967 | Hultgren et al. | 220/338 |
| 3,576,518 | 4/1971 | Bazille et al. | 339/98 |
| 3,601,746 | 8/1971 | Teagno | 339/4 R |
| 3,745,228 | 7/1973 | Vogt | 339/98 |
| 3,864,000 | 2/1975 | Coller et al. | 339/17 LC |
| 3,879,099 | 4/1975 | Shaffer | 339/99 R |
| 3,920,303 | 11/1975 | Pittman et al. | 339/91 R |
| 4,003,625 | 1/1977 | Vladic | 339/176 MP |
| 4,062,616 | 12/1977 | Shaffer | 339/99 R |
| 4,128,289 | 12/1978 | Occhipinti | 339/75 MP |
| 4,138,184 | 2/1979 | Knopp | 339/97 P |
| 4,185,882 | 1/1980 | Johnson | 339/176 MP |
| 4,196,956 | 4/1980 | Hoffman | 339/107 |
| 4,209,217 | 6/1980 | Gudaitis et al. | 339/75 MP |
| 4,341,430 | 7/1982 | Crawford | 339/99 R |

FOREIGN PATENT DOCUMENTS

| | | |
|---|---|---|
| 1304823 | 8/1962 | France . |
| 1324140 | 3/1963 | France . |
| 1214316 | 12/1970 | United Kingdom . |
| 2091955 | 8/1982 | United Kingdom . |

*Primary Examiner*—John McQuade

[57] ABSTRACT

The invention is a hinged electrical connector for terminating conductors of flat cable, using finger pressure to close the hinged parts of the connector over the cable.

4 Claims, 5 Drawing Figures

FLAT CABLE ELECTRICAL CONNECTOR

This application is a continuation in part of Application Ser. No. 204,099, filed Nov. 5, 1980 now U.S. Pat. No. 4,341,430.

The present invention relates to electrical connectors for terminating conductors of flat cable, and is directed to a hinged connector using finger pressure to close the hinged parts thereof over the cable, and penetrate electrical terminals into the cable to establish electrical connections with the cable conductors.

Flat cable comprises an array of parallel insulation covered wires or conductors interconnected by a web of insulation material which maintains the conductors in the array. Electrical connectors for flat cable comprise electrical terminals contained in an insulation housing which is closed over the cable. One such connector, as disclosed in U.S. Pat. No. 4,160,573 requires stripping the insulation from the cable, leaving exposed portions of the cable conductors to be terminated by electrical contacts in the connector. Another type connector, as disclosed in U.S. Pat. No. 3,820,055 does not require stripping. However, a force applying tool, such as an arbor press, is necessary to press the unstripped cable against sharpened ends of the terminals so that the terminals penetrate the cable.

The connector of the present inventin does not require stripping of the cable, nor a force applying press to penetrate terminals into the cable. Only finger pressure is needed to pivot one part of the connector toward another part containing the terminals. Sufficient mechanical advantage is obtained by finger pressure on the pivoted parts, to penetrate the terminals into the unstripped cable and establish electrical connections with the conductors.

A base portion of the connector contains the terminals and is provided with a hinge pin. A holder portion of the connector holds the unstripped cable, and has hook portions pivotal upon the hinge pin to pivot the cable against and into conductor terminating portions of the terminals. The holder comprises a manually actuated lever.

A flat cable connector according to the invention is characterized in that; a flat conductor cable electrical connector, comprises, a base, a holder pivoted to the base and having a pocket receiving multiple electrical conductors of a flat conductor cable, multiple electrical terminals mounted on the base and having terminal lead portions projecting from the base and having conductor engaging portions projecting toward the pocket, penetrating the cable and engaging respective conductors establishing electrical connections therewith. The invention further is characterized in that; the base has a hinge pin, the cover has hook portions pivotally mounted on the hinge pin, the cover has terminal receiving channels therein intercepting the cable receiving pocket, initially the conductor engaging portions are removed from the channels allowing receipt of the cable in the pocket without impediment, and upon pivoting the holder toward the base, the conductor engaging portions enter the channels and penetrate the cable and establish electrical connections with the conductors, and the holder comprises a manually actuated lever projecting outwardly away from the hook portions.

An object of the invention is to provide a hinged electrical connector for terminating conductors of flat cable, with finger pressure being sufficient to close the hinged parts of the connector and penetrate electrical terminals into the cable to terminate the conductors.

Another object of the invention is to provide an electrical connector with a holder portion which is mounted to pivot along a hinge portion of a base and pivot a flat cable into conductor terminating portions of electrical terminals.

Another object of the invention is to provide an electrical connector of compact size and capable of assembly onto a flat cable ithout the use of special tools.

Other objects and advantages of the present invention will become apparent by way of example from the following description taken in conjunction with the drawings.

FIG. 1 is an enlarged fragmentary perspective of a flat cable connector completely assembled on a flat cable and mounted on a circuit board.

FIGS. 2 and 3 are sections taken along the lines 2—2 and 3—3, respectively, of FIG. 1.

Figure 4:
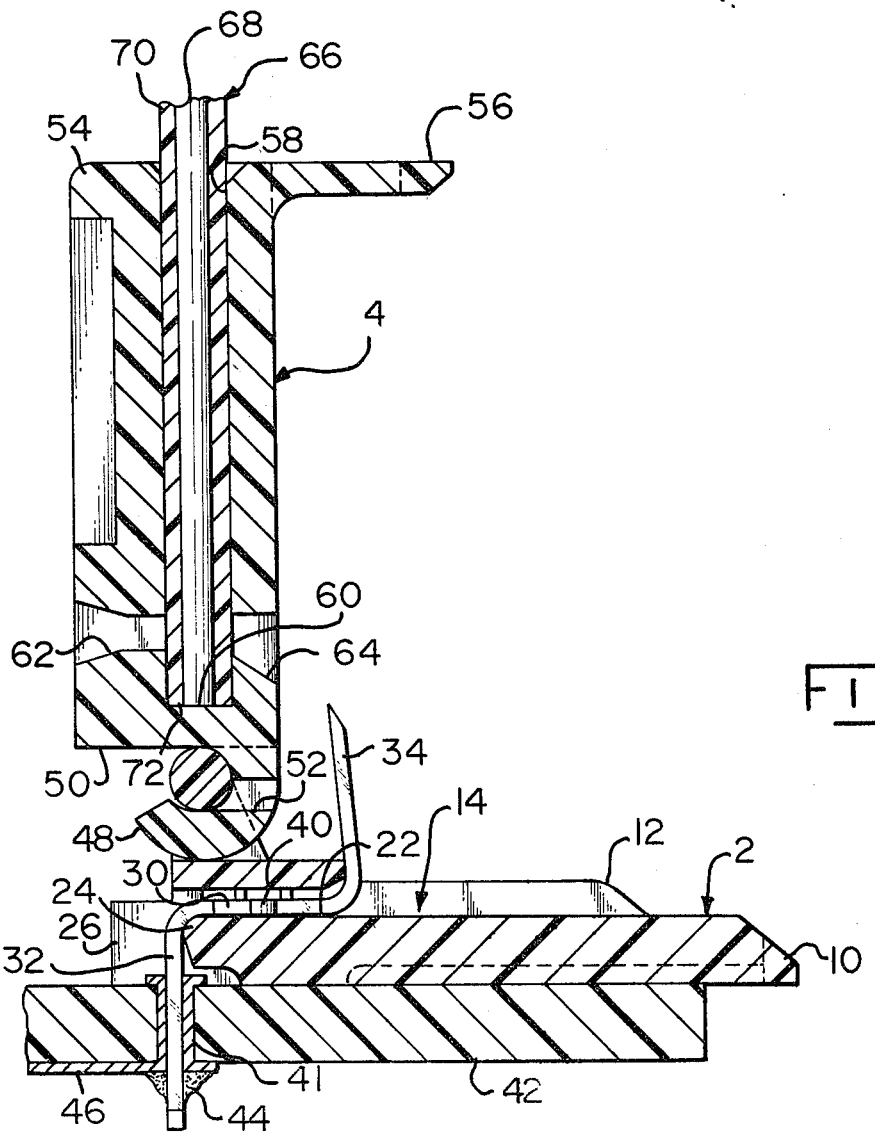
FIG. 4 is a section view similar to FIG. 2 with the connector partially assembled, immediately prior to complete assembly thereof.
Figure 5:
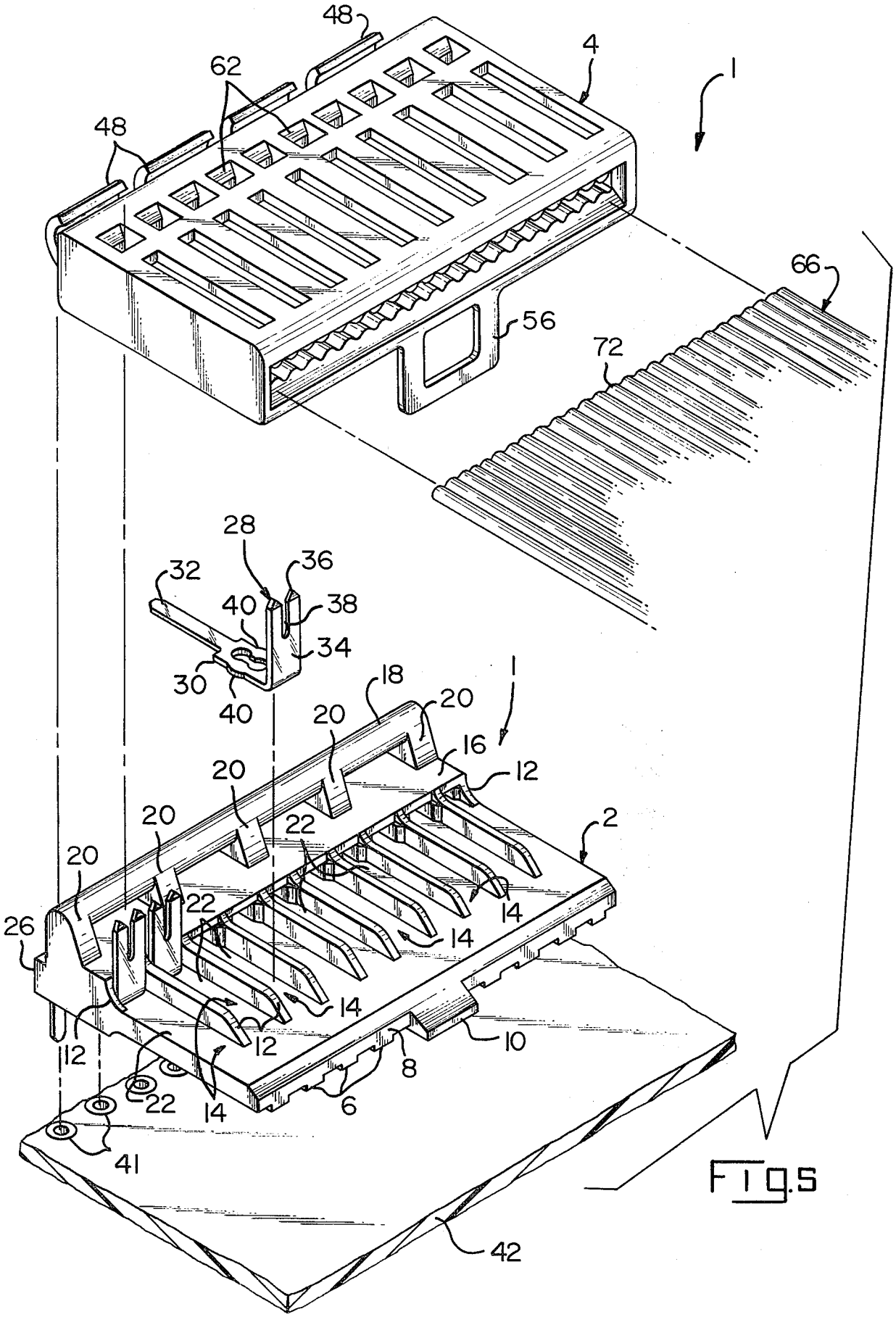
FIG. 5 is a perspective view of the connector with parts exploded for illustration purposes.

As shown by way of example in FIGS. 1, 2, 3, 4 and 5, a flat cable connector (1) has a base (2) and a holder (4), each of unitary molded plastic construction. FIG. 5 shows the base (2) generally of flat plate form with inverted ribs (6) extending toward an edge of an end (8) of the base. A latch finger (10) projects from the end (8). An obverse surface of the base includes parallel channel walls (12). Terminal receiving channels (14) are defined between adjacent walls (12). The channels (14) are partially covered by a top wall (16). A cylindrical hinge pin (18) is supported by integral, spaced apart brackets (20) integral with and projecting from the wall (16).

Figure 2:
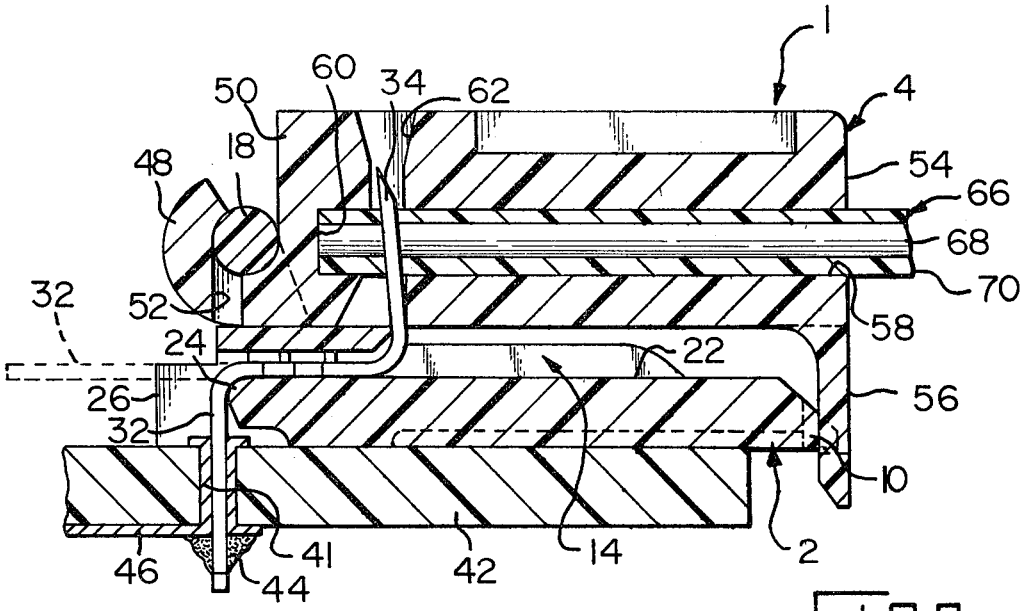

With reference to FIGS. 2 and 4, floors (22) of the channels (14) project under the top wall (16) and end in an arcuate, terminal shaping surface (24) recessed from an end (26) of the base (2). The purpose of the surface (24) will be explained hereinafter.

By way of example, FIG. 5, illustrates an electrical terminal (28) stamped and formed from resilient sheet metal and comprising, a body portion (30), an integral projecting terminal lead (32) and an integral conductor engaging portion (34) of planar plate form bent outwardly perpendicular of the plane of the body portion. The conductor engaging portion (34) has a free end (36) with a sharpened edge for penetrating an electrical flat cable, and a conductor receiving slot (38) opening into the free end (36). Opposed sides of the slot (38) are resilient conductor engaging jaws operating in a manner described hereinafter.

The body portion (30) of the terminal (28) has opposed projections (40) which wedge against respective walls (12) when the body portion (30) is forcefully inserted into a channel (14). Each channel (14) receives a terminal (28) therein, with each body portion (28) of a respective terminal against a respective floor (22), and with each portion (34) of a respective terminal projecting from a channel (14) outwardly above the top wall (16) and aligned parallel with the axis of the hinge pin (18). As shown in FIG. 2, each lead portion (32) of a respective terminal projects outwardly of a channel (14) and over a terminal shaping surface (24). Each lead portion (32) may project over the surface (24) in a manner outwardly directly of the end (26), as shown in phantom outline, or in a manner bent over and along the respective shaping surface (24) and outwardly away from and below the end (26). Each lead portion (32) is adapted for insertion into a respective aperture (41) of a circuit board (42) and joined by solder (44) electrically to a respective plated electrical circuit (46 ) extending along the surface of the circuit board (42) and along the respective aperture (41). As shown in FIG. 2, the base (2) is mounted with the ribs (6) in registration against the circuit board (46). It is understood that the base (2) may be mounted alternately with the end (26) in registration against the circuit board (42), provided that the lead portion (32) of each respective terminal (28) projects from the end (26) as shown in phantom outline.

Figure 1:
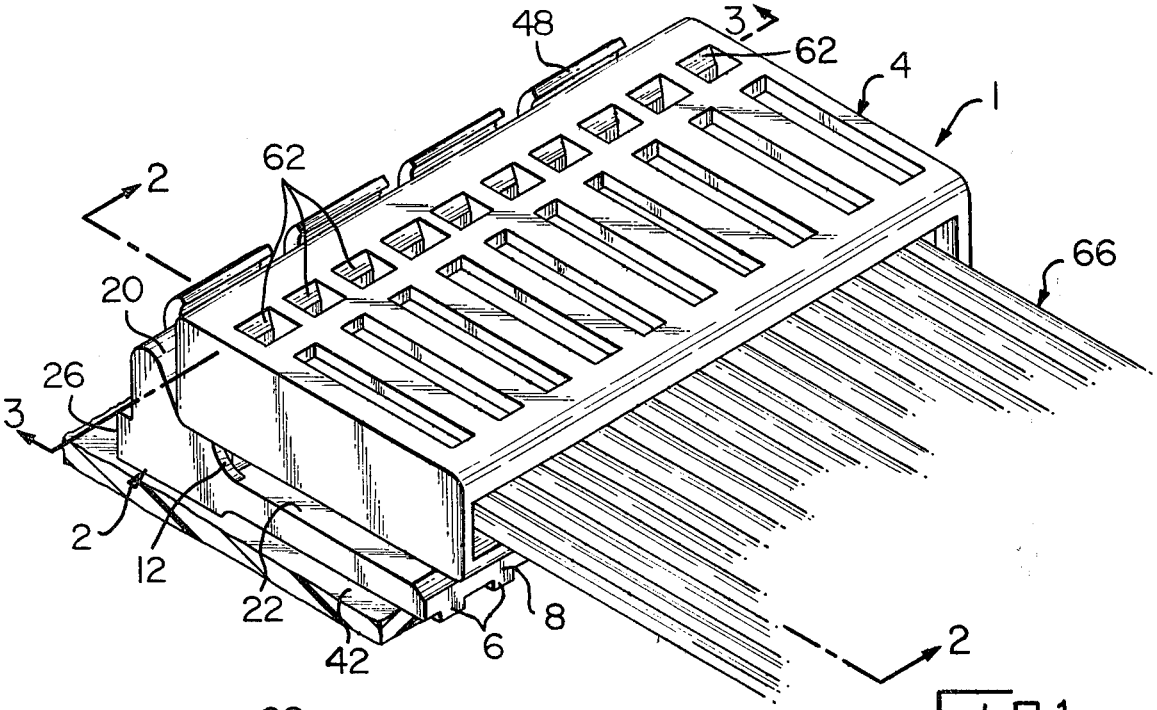

By way of example, FIGS. 1, 2, 3, 4 and 5 show hook portions (48) molded along one end (50) of the holder (4). Apertures (52) through the hook portions (48) are formed by core pins used during the molding process to assist in forming the hook portions (48). When the core pins are withdrawn from the finished hook portions (48) the apertures (52) remain as a product of the molding process. An end (54) of the holder (4) opposite the end (50) is molded with a depending hasp (56). A flat cable receiving pocket (58) is molded into the end (54) and extends toward the end (50). A bottom wall (60) of the pocket (58) lies within the interior of the holder (4), proximate the end (50). FIGS. 1 and 4 show plural terminal receiving channels (62) intercepting the pocket (58). The channels (62) are aligned with respective portions (34) of the terminals and are shaped with tapered funnel walls (64).

Figure 3:
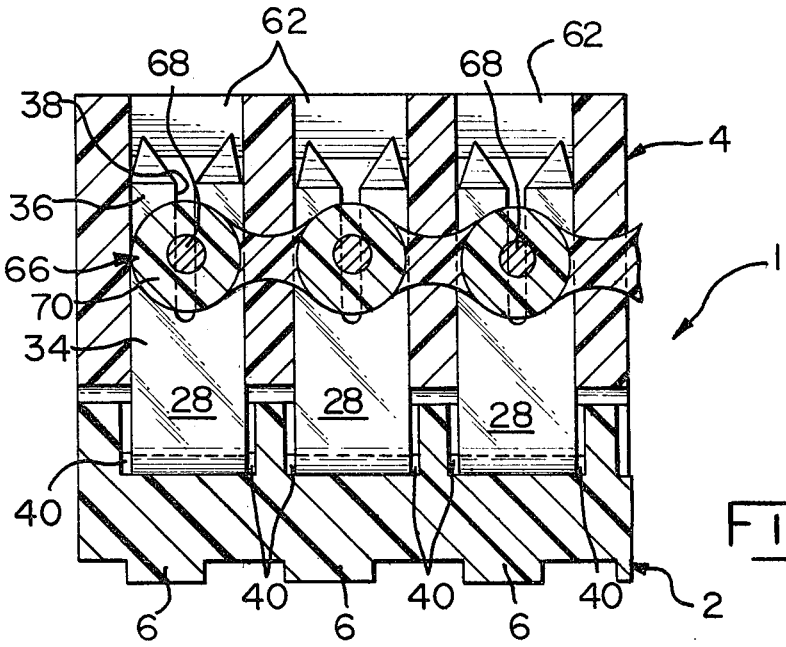

FIGS. 4 and 5 show an electrical, flexible flat cable (66) of the known type in which plural, parallel conductors (68) are aside one another and are encircled by a unitary sheath of insulation material (70). The cable (66) is clipped to provide an edge (72) extending transversely of the axes of the conductors (68). The cable is then inserted into the pocket (58) of the holder (4). The conductors (68) bridge across the channels (62). The holder (4), with the cable (66) assembled thereto, is then assembled to the base (2) by hooking the hook portions (48) onto the hinge pin (18). The holder (4) then is in a position shown in FIG. 4. Thereafter finger pressure is applied to the holder (4), using the holder itself as a lever, to pivot the holder about the hinge pin (18) toward a position shown in FIG. 2. During pivoting of the holder the terminal portions (34) are directed by the funnel surfaces (64) into the channels (62). Thereafter the walls of the channels guide and direct the terminal portions (34) perpendicularly against the cable (66). As the holder continues pivoting about the hinge pin (18), the edges (36) of the terminals penetrate the cable insulation (70), and, as shown in FIG. 3, the cable conductors (68) are forced into and along the terminal slots (38). The sides of the slots (38) are resilient jaws which grip opposite sides of the conductors (68), establishing electrical connections therewith. The cable (66) is confined and held in flattened configuration by the walls of the pocket (58) during penetration by the terminal portions (34). The assembly is completed when the hasp (56) hooks over the latch finger (10) and retains together the base (2) and cover (4).

Although a peferred embodiment of the present invention is disclosed, other embodiments and modifications thereof which would be apparent to one having ordinary skill are intended to be covered by the spirit and scope of the appended claims.

I claim:

1. A flat conductor cable electrical connector, comprising, a base, a holder pivoted to the base and having a pocket receiving multiple electrical conductors of a flat conductor cable, multiple electrical terminals mounted on the base and having terminal lead portions projecting from the base, conductor engaging portions projecting toward the pocket for penetrating the cable and engaging respective conductors to establish electrical connections therewith, the base being integrally formed with a hinge pin located along a first end, the cover being integrally formed with hook portions located along a first end and pivotally mounted on the hinge pin, the cover providing a rigid cable supporting enclosure and having terminal guiding channels therein intercepting the cable receiving pocket; the conductor engaging portions being remote from the guiding channels allowing receipt of the cable in the pocket without impediment so that upon pivoting the holder toward the base, the conductor engaging portions enter into the channels and penetrating the cable and establishing electrical connections with the conductors, the holder comprising a manually actuatable lever projecting outwardly away from the hook portions, and the conductor engaging portions of the terminals being located nearer the axis of the hinge pin then a second end of the base opposite the first end of the base.

2. The connector according to claim 1, characterized in that; the base includes terminal receiving channels separated by sidewalls, the terminals have body portions which span across respective terminal receiving channels and wedge between the sidewalls, the conductor engaging portions project perpendicularly from the body portions outwardly of the terminal receiving channels, and the terminal lead portions project outwardly of the terminal receiving channels and project over arcuate shaping surfaces on the terminal, receiving channels.

3. The connector according to claim 1 or claim 2, characterized in that; the conductor engaging portions of the terminals are of planar plate form aligned parallel to the axis of the hinge pin, the conductor engaging portions including slots opening into the free ends and receiving the conductors of the cable therein, the free ends of the conductor engaging portions have sharpened edges penetrating the cable upon entrance thereof into the slots the sides of the slots are resilient conductor engaging jaws engaging the conductors of the cable and establishing electrical connections therewith.

4. The connector according to claim 1 or claim 2 characterized in that; second ends respectively of the holder and the base include interlocking latches.

* * * * *